US008074914B2

(12) United States Patent
Männikkö

(10) Patent No.: US 8,074,914 B2
(45) Date of Patent: Dec. 13, 2011

(54) CRUSHING BUCKET

(75) Inventor: Ari Männikkö, Nastola (FI)

(73) Assignee: Allu Finland Oy, Orimattila (FI)

( * ) Notice: Subject to any disclaimer, the term of this patent is extended or adjusted under 35 U.S.C. 154(b) by 0 days.

(21) Appl. No.: 12/728,682

(22) Filed: Mar. 22, 2010

(65) Prior Publication Data

US 2011/0073693 A1 Mar. 31, 2011

(30) Foreign Application Priority Data

Mar. 24, 2009 (FI) ..... 20095301

(51) Int. Cl.
*B02C 19/00* (2006.01)

(52) U.S. Cl. ..... 241/101.72; 241/277

(58) Field of Classification Search ..... 241/101.72, 241/277

See application file for complete search history.

(56) References Cited

U.S. PATENT DOCUMENTS

| | | | | |
|---|---|---|---|---|
| 2,265,649 | A * | 12/1941 | Krehbiel | 241/277 |
| 5,899,535 | A | 5/1999 | LeBlond | |
| 7,913,430 | B2 * | 3/2011 | Mannikko | 37/403 |

FOREIGN PATENT DOCUMENTS

| | | | |
|---|---|---|---|
| GB | 2 278 071 | A | 11/1994 |
| GB | 2 401 096 | A | 11/2004 |
| JP | 9053252 | A | 2/1997 |
| JP | 2006305513 | A | 11/2006 |
| WO | WO 01/58595 | A1 | 8/2001 |

OTHER PUBLICATIONS

Finnish Search Report for Finnish Application No. 20095301, dated Nov. 19, 2009, English translation with original Finnish language document attached.

* cited by examiner

*Primary Examiner* — Mark Rosenbaum
(74) *Attorney, Agent, or Firm* — Sterne, Kessler, Goldstein & Fox P.L.L.C.

(57) ABSTRACT

The invention relates to a crushing bucket, which has been designed as an excavator or loader bucket. It comprises a bottom plate (1), side walls (2), and working drums (6) at a rear part of the bucket, which are rotatable about a shaft (6) thereof and crush, while rotating, a bucket-held material and at the same time deliver crushed material out of the bucket between or through the working drums (6). It also comprises enclosures (4) for the power transmission and bearing assemblies of the working drums (3), said enclosures being delimited by frame panels (**4*b*) to which the working drums' (6) bearing cups are attachable. The working drum (6) is provided with at least one crushing tool (7), which is a continuous component extending substantially all the way along the length of a shaft (6*a***).

18 Claims, 2 Drawing Sheets

CRUSHING BUCKET

The invention relates to a crushing bucket, which has been designed as an excavator or loader bucket, comprising a bottom plate, side walls, and working drums at a rear part of the bucket, which are rotatable about a shaft thereof and crush, while rotating, a bucket-held material and at the same time deliver crushed material out of the bucket between or through the working drums, as well as enclosures for the power transmission and bearing assemblies of the working drums, said enclosures being delimited by frame panels to which the drums' bearing cups are attachable.

Such a bucket is known from the Applicant's international patent application WO 0158595. This prior known bucket features crushing teeth mounted between the working drums' flanges. This type of structure calls for a multitude of welding-attached elements. A problem with such a structure is that each separate welded component represents a source of concentrated stress and thereby leads to poorer fatigue resistance. Particularly weak points are joints transverse to the longitudinal direction of a shaft, as well as weld terminations on the shaft.

It is an object of the invention to provide a bucket of the foregoing type, which does not have the above-mentioned problems.

This object is achieved according to the invention in such a way that the working drum is provided with at least one crushing tool, which is a continuous component extending all the way along the entire shaft length.

When a crushing tool extends continuously across the shaft length, the weld joint for attaching the crushing tool to the shaft can be established as a continuous joint which is equal to the entire shaft in terms of its length, thus avoiding a plurality of weld terminations. All weld joints also extend lengthwise of the shaft, nor is there any need for weld joints transverse to the longitudinal shaft direction. Thus, the prior art problem, i.e. stress concentrations applied to the shaft, is obviated.

At the same time, the crushing tool according to the invention provides a structural member which not only does the crushing but also functions as a load-bearing, shaft-strength enhancing component.

Figure 1:
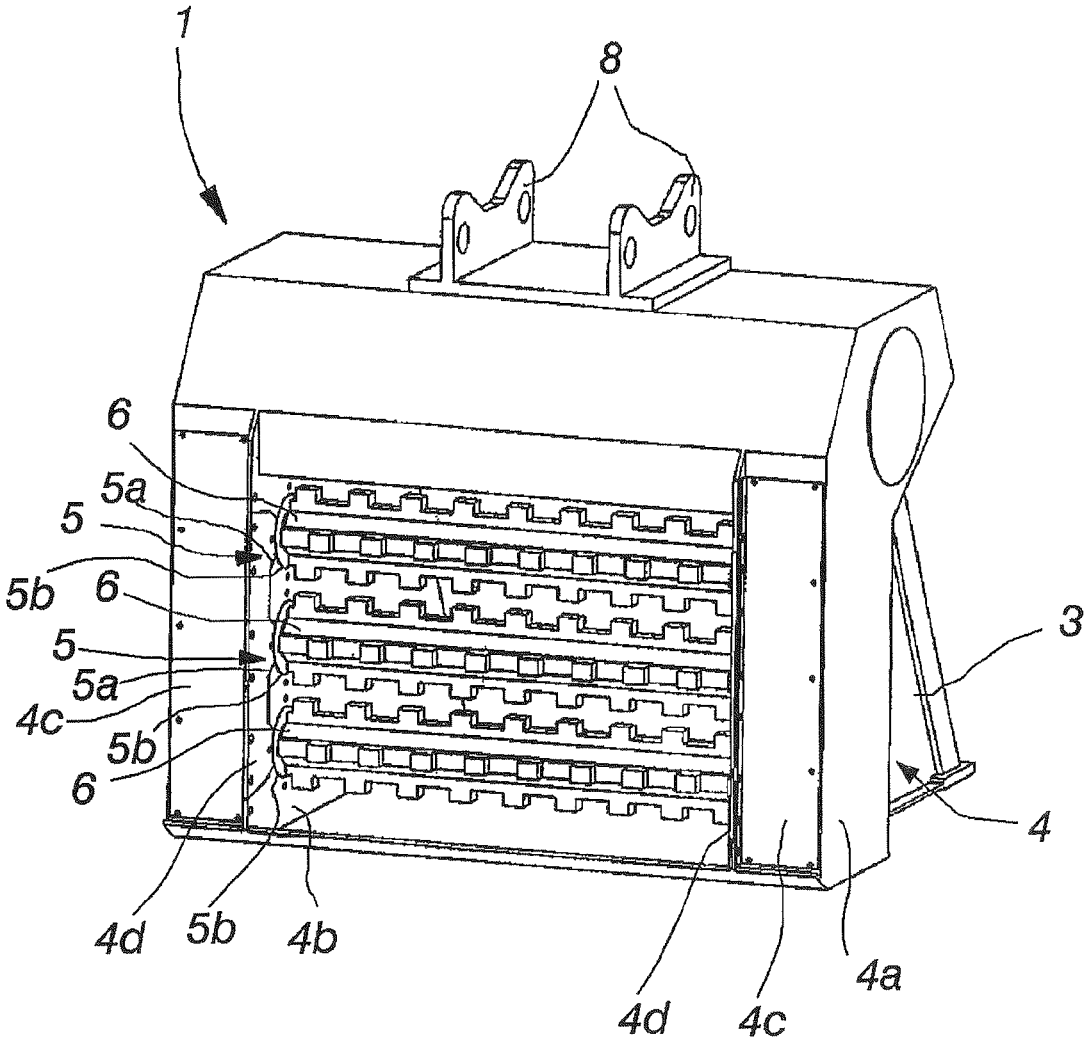
Figure 2:
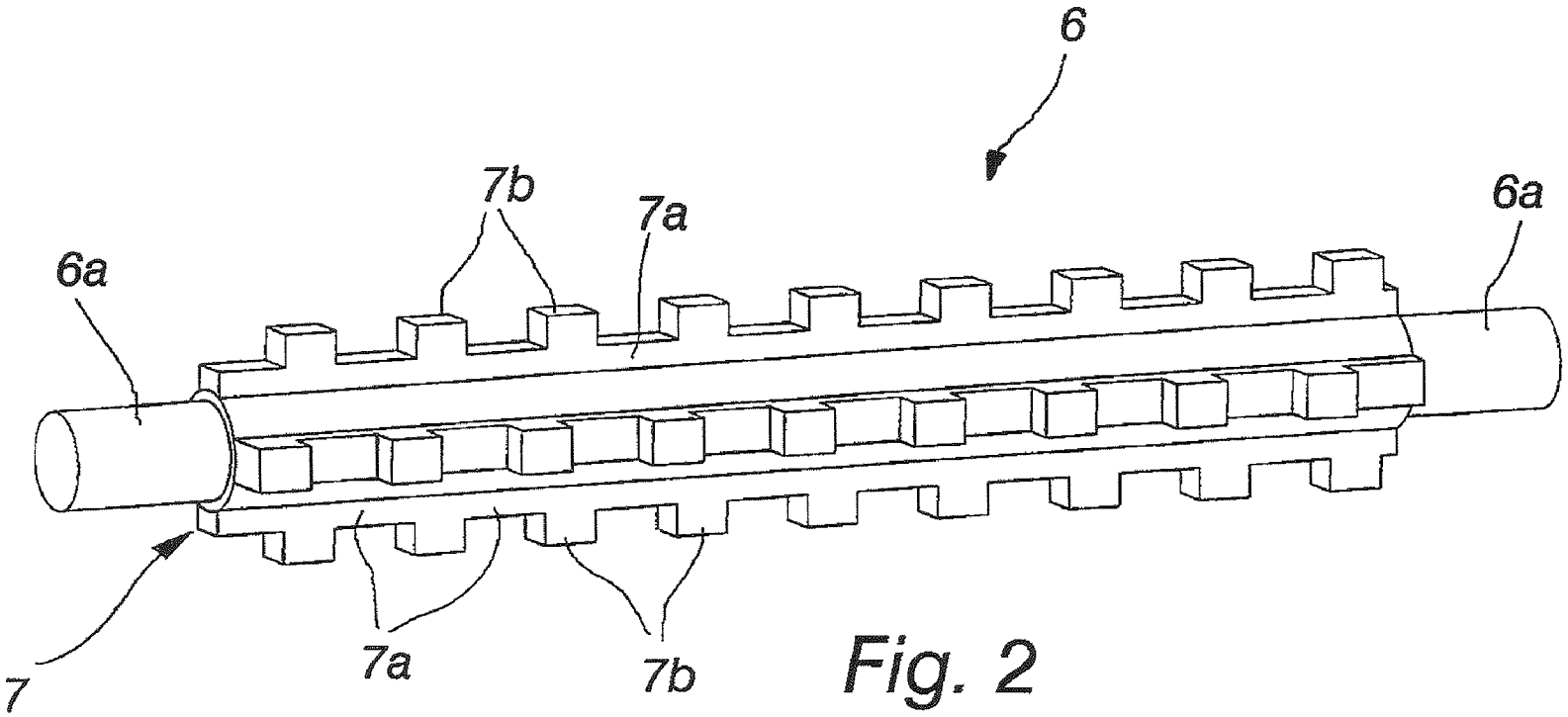

One exemplary embodiment of the invention will now be described more closely with reference to the accompanying drawings, in which FIG. 1 shows a bucket of the invention with its working drums in a partially cut-away perspective view from behind, and FIG. 2 shows a working drum according to one embodiment of the invention.

The bucket according to the invention can be attached to serve as an excavator or loader bucket, for which the bucket has attachment brackets 8 on its top.

A bucket 1 comprises a bottom plate 2, side walls 3, and working drums 6 at a rear part of the bucket, which are rotatable about a shaft 6*a* thereof and crush, while rotating, a bucket-held material and at the same time deliver crushed material out of the bucket between or through the working drums 3.

Associated with rear parts of the side walls 3 are enclosures 4 for the power transmission and bearing assemblies of the working drums 6. The enclosures 4 include outer side walls 4*a* and, in the illustrated embodiment, the enclosures 4 are separated from an interior of the bucket by frame panels 4*b* to which the working drums' 6 bearing cups (not shown) are attachable. In the illustrated case, the frame panels 4*b* are present as direct extensions of the side walls 3 and are made of the same material as the side walls 3.

The frame panels 4*b* are provided with take-up and attachment formations 5 for the working drums 6, which establish an installation path 5*a* and take-up openings 5*b* into which the working drums 3, along with the bearings and drive gears therefore, are mountable in place as a single assembly from behind the bucket.

In the illustrated embodiment, the working drums 6 are horizontal with the bucket in an operating position, but can also be vertical. In the depicted case, the frame panels 4*b* are nevertheless present between the outer side walls 4*a* of the enclosures 4 at a distance from the outer side walls 4*a*, thus providing sprocket and bearing boxes between the frame panels 4*b* and the enclosures' outer side walls 4*a*.

Attachable to rear parts of the frame panels 4*b* are complementary pieces 4*d*, which delimit the take-up openings 5*b* of working drums present in the frame panel and block the installation path 5*a* of working drums leading to the take-up openings. The sprocket and bearing boxes established between the frame panels 4*b* and the enclosures' outer side walls 4*a* are closable from behind by removably mounting backwall panels 4*c* on a rear-facing side of the bucket. Preferably, each backwall panel 4*c* is fastened at one edge thereof by bolts or screws both to the frame panel 4*b* and to the complementary piece 4*d* and at the other edge thereof to a rear edge of the outer side wall 4*a*. Thereby, the enclosures' 4 outer side walls 4*a* leave their external sides as smooth wear plates, which need not be opened. In the process of working with the bucket, the enclosures' 4 backwall panels 4*c* are not exposed to a substantial stress applied by rocks, thus enabling the same to be opened even after a long working period.

The working drum 6 according to one embodiment of the invention is depicted in more detail in FIG. 2 without sprockets and bearing boxes mounted on the ends of the shaft 6*a*. In this case, the working drum 6 is constructed from the elongated shaft 6*a*. The working drum 6 includes four examples of crushing tools 7 (one is not visible in FIG. 2), each of which extends substantially all the way along the length of the shaft 6*a* except for extreme ends of the shaft 6*a*. The crushing tools 7 are distributed on the working drum 6 at radial spaces of 90 degrees. It should be noted at this point that the number of crushing tools 7 on the working drum 6 can be for example three, in which case the crushing tools 7 are distributed on the working drum 6 at radial spaces of 120 degrees. The number of crushing tools 7 can be other than these, the desirable aspect being that the tools 7 are distributed on the working drum 6 at equidistant radial intervals. Furthermore, the crushing tools 7 are preferably made from a material (steel alloy) which is a stronger wear-resistant material than that of the shaft.

The crushing tool 7 includes an elongated rib 7*a* extending along and bearing on the shaft 6 preferably all the way along its length. For this purpose, the rib 7*a* is shaped for a bottom surface preferably conforming to the outline of the shaft 6*a* in terms of its cross-section. In addition, the rib 7*a* features a plurality of tooth members 7*b* present on a top surface opposite with respect to the bottom surface. The tooth members 7*b* are disposed along the rib 7*a* at equal spaces throughout the length of the rib 7*a*. The tooth members 7*b* are disposed on the rib 7*a* so as to point outward in a radial direction of the working drum 6, thus establishing a serration type crushing tool 7. *The tooth member 7*b* can be welded or reinforced with a wear-resistant weld. The tooth member can also be provided with a separately soldered claw piece.

The rib 7*a*, and thereby the crushing tool 7, is attached to the shaft 6 by welding. The crushing tool 7 according to the invention can be welded to the shaft 6 with a weld extending substantially over the entire length of the shaft 6. The weld follows the shape and direction of the bottom surface edges of the rib 7*a*, which in this embodiment is lengthwise of the shaft 6 and straight. This enables avoiding weld joints crosswise to the longitudinal direction of the shaft 6*a*.

Furthermore, the tooth members 7*b* of adjacent crushing tools 7 can be in coincidence with each other in the direction of the shaft 6*a* of the working drum 6. However, the tooth members 7*b* of adjacent crushing tools 7 may also have locations which are offset from each other in the direction of the shaft 6*a* of the working drum 6. For example, the offset between such members can be about a half of the gap between two adjacent tooth members 7*b* of the crushing tool 7, as shown in FIGS. 1 and 2.

According to one preferred embodiment of the invention, the crushing tool 7 is shaped in such a way that the shape follows a gentle spiral form along the shaft surface.

The present invention is not limited to the presented embodiments, but can be applied in a variety of manners within the scope of protection defined by the claims. The tooth members 7*b*, for example, can have a shape which is other than rectangular or the shaft can have a cross-sectional shape, especially in the longitudinal direction of the shaft at the location of a crushing tool, which is other than circular.

What is claimed is:

1. A crushing bucket suitable for use as an excavator or loader bucket, comprising:

a bottom plate;

side walls;

working drums at a rear part of the bucket, wherein the working drums are rotatable about a shaft thereof and crush, while rotating, a bucket-held material and at the same time deliver crushed material out of the bucket between or through the working drums; and enclosures for power transmission and bearing assemblies of the working drums, said enclosures being delimited by frame panels to which bearing cups for the working drums are attachable, wherein the working drum is provided with at least one crushing tool, which is a continuous component extending substantially across the length of a shaft, and wherein the crushing tools are attached to the working drum by welding, the weld continuing substantially all the way along the entire length of the shaft.

2. A bucket as set forth in claim 1, wherein the working drum is provided with three crushing tools distributed over the drum at radial spaces of 120 degrees.

3. A bucket as set forth in claim 2, wherein the crushing tool includes a rib extending all the way along the length of the shaft and featuring radially outward pointing tooth members.

4. A bucket as set forth in claim 3, wherein the crushing tool is designed as a longitudinally gentle spiral on the shaft.

5. A bucket as set forth in claim 3, wherein the tooth members of adjacent crushing tools are in coincidence with each other in the direction of the working drum's shaft and/or disposed in such way that the tooth members of adjacent crushing tools are offset from each other in the direction of the working drum's shaft.

6. A bucket as set forth in claim 5, wherein the crushing tool is designed as a longitudinally gentle spiral on the shaft.

7. A bucket as set forth in claim 2, wherein the crushing tool is designed as a longitudinally gentle spiral on the shaft.

8. A bucket as set forth in claim 1, wherein the working drum is provided with four crushing tools distributed over the drum at radial spaces of 90 degrees.

9. A bucket as set forth in claim 8, wherein the crushing tool includes a rib extending all the way along the length of the shaft and featuring radially outward pointing tooth members.

10. A bucket as set forth in claim 9, wherein the crushing tool is designed as a longitudinally gentle spiral on the shaft.

11. A bucket as set forth in claim 9, wherein the tooth members of adjacent crushing tools are in coincidence with each other in the direction of the working drum's shaft and/or disposed in such way that the tooth members of adjacent crushing tools are offset from each other in the direction of the working drum's shaft.

12. A bucket as set forth in claim 11, wherein the crushing tool is designed as a longitudinally gentle spiral on the shaft.

13. A bucket as set forth in claim 8, wherein the crushing tool is designed as a longitudinally gentle spiral on the shaft.

14. A bucket as set forth in claim 1, wherein the crushing tool includes a rib extending all the way along the length of the shaft and featuring radially outward pointing tooth members.

15. A bucket as set forth in claim 14, wherein the crushing tool is designed as a longitudinally gentle spiral on the shaft.

16. A bucket as set forth in claim 14, wherein the tooth members of adjacent crushing tools are in coincidence with each other in the direction of the working drum's shaft and/or disposed in such way that the tooth members of adjacent crushing tools are offset from each other in the direction of the working drum's shaft.

17. A bucket as set forth in claim 16, wherein the crushing tool is designed as a longitudinally gentle spiral on the shaft.

18. A bucket as set forth in claim 1, wherein the crushing tool is designed as a longitudinally gentle spiral on the shaft.

* * * * *